US007161444B2

(12) United States Patent
Saitoh et al.

(10) Patent No.: US 7,161,444 B2
(45) Date of Patent: Jan. 9, 2007

(54) DIRECTIONAL COUPLER AND HIGH-FREQUENCY CIRCUIT DEVICE

(75) Inventors: Atsushi Saitoh, Muko (JP); Michiko Nakagawa, Nagaokakyo (JP)

(73) Assignee: Murata Manufacturing Co., Ltd. (JP)

( * ) Notice: Subject to any disclaimer, the term of this patent is extended or adjusted under 35 U.S.C. 154(b) by 0 days.

(21) Appl. No.: 10/866,759

(22) Filed: Jun. 15, 2004

(65) Prior Publication Data

US 2005/0030123 A1 Feb. 10, 2005

(30) Foreign Application Priority Data

Aug. 8, 2003 (JP) ..... 2003-290688

(51) Int. Cl.
*H01P 5/12* (2006.01)
*H01P 3/08* (2006.01)

(52) U.S. Cl. ..... 333/109; 333/116; 333/120

(58) Field of Classification Search ..... 333/109, 333/116, 120; *H01P 5/22*
See application file for complete search history.

(56) References Cited

U.S. PATENT DOCUMENTS 4,023,123 A * 5/1977 Reindel ..... 333/123
4,093,928 A * 6/1978 Proctor ..... 333/120
4,471,329 A * 9/1984 Cavalieri d'Oro ..... 333/1.1
4,492,939 A * 1/1985 Burns ..... 333/116
4,525,690 A * 6/1985 De Ronde ..... 333/116
2003/0085773 A1* 5/2003 Grunewald ..... 333/116

FOREIGN PATENT DOCUMENTS

JP 2002-141714 * 5/2002

OTHER PUBLICATIONS

Bialkowski, Marek E.; "Analysis and Design of a Circular Disc 3 dB Coupler"; IEEE Transactions on Microwave Theory and Techniques, vol. 42, No. 8, Aug. 1994; pp. 1437-1442.
G.P. Riblet, "Matched Waveguide Five-Port with Partial Symmetry for use in Six-Port Measurement Systems", I.E.E. Proceedings-H/Microwaves, Antennas and Propagation, vol. 135, No. 1, pp. 13-16 (Feb. 1988).
Kawai et al., "Planar-Circuit-Type 3dB Quadrature Hybrids", IEEE MTT-S International Symposium Digest, vol. 1, pp. 205-208 (May 23, 1994).

* cited by examiner

*Primary Examiner*—Dean Takaoka
(74) *Attorney, Agent, or Firm*—Dickstein, Shapiro, LLP.

(57) ABSTRACT

A directional coupler includes a conductor pattern formed on a substrate. The conductor pattern includes first to fourth lines radially extending from a predetermined point on the substrate, and conductive pattern portions. Each line has a first point a first distance from the predetermined point, and a second point a second distance from the predetermined point, wherein the first and second distances have different values. Respective first or second points of adjacent lines are connected by curves, straight lines, or bent lines with obtuse angles, and the crossing angle defined at an intersection of the connecting lines and edges of adjacent lines is obtuse. The conductive pattern portions are defined by the first to fourth lines and the connecting lines. The conductive pattern portions break degeneracy of a plurality of resonant modes.

8 Claims, 17 Drawing Sheets

REFLECTION CHARACTERISTIC

ISOLATION CHARACTERISTIC

TRANSMISSION CHARACTERISTIC

TRANSMISSION CHARACTERISTIC

| | @76.5GHz | | | |
|---|---|---|---|---|
| | S11 | S21 | S31 | S41 |
| r1=0.53 | −23.07 | −3.172 | −3.208 | −22.18 |
| r1 > 0.53 | −22.48 | −3.263 | −3.157 | −21.97 |
| r1 < 0.53 | −20.76 | −3.290 | −3.137 | −21.45 |
| | | | | |
| SL=0.47 | −21.84 | −3.187 | −3.209 | −21.72 |
| SL > 0.47 | −27.87 | −2.726 | −3.652 | −26.85 |
| SL < 0.47 | −16.26 | −3.762 | −3.023 | −15.35 |

FIG. 8

PRESENT NVENTION (A) $\theta$ =0[deg]

(B) $\theta$ =60[deg]

(C) $\theta$ =120[deg]

COMPARATIVE EXAMPLE (D) $\theta$ =0[deg]

(E) $\theta$ =60[deg]

(F) $\theta$ =120[deg]

DIRECTIONAL COUPLER AND HIGH-FREQUENCY CIRCUIT DEVICE

BACKGROUND OF THE INVENTION

1. Field of the Invention

The present invention relates to a directional coupler used in the microwave or millimeter-wave band, and to a high-frequency circuit device including the same.

2. Description of the Related Art

In the art, line couplers such as hybrid-ring couplers are used as microwave directional couplers having lines on a substrate. Characteristics of such line couplers, such as the power distribution ratio, are determined by appropriately designing the line lengths and the characteristic impedances of lines that connect four ports.

In line couplers however, in a high-frequency region, namely the millimeter-wave band of a propagating signal, the line lengths of the lines that connect the ports are short while the line widths are relatively wide. Thus, it is difficult to form a line pattern on the substrate.

One directional coupler used in the millimeter-wave band or the like that overcomes the foregoing problem is disclosed in Marek E. Bialkowski, Senior Member, IEEE, and Shaun T. Jellett, Member, IEEE, "Analysis and Design of a Circular Disc 3 dB Coupler," IEEE TRANSACTIONS ON MICROWAVE THEORY AND TECHNIQUES, VOL. 42, NO. 8, AUGUST 1994. FIG. 17 shows the structure of the directional coupler disclosed in this publication. As shown in FIG. 17, the directional coupler includes a round conductor C, lines L1, L2, L3, and L4 radially extending in four directions from the round conductor C, and open-end stubs S1 and S2. The stub S1 projects from the round conductor C between the lines L1 and L4, and the open-end stub S2 projects from the round conductor C between the lines L2 and L3.

The directional coupler shown in FIG. 17 has a symmetry axis that extends through the two stubs S1 and S2, and another symmetry axis orthogonal to this axis. Thus, a plurality of resonant modes occur in the round conductor C. Without the stubs S1 and S2, the resonant modes are degenerate, whereas, with the stubs S1 and S2, degeneracy of the modes is broken, exhibiting directional coupler characteristics.

However, the directional coupler shown in FIG. 17 experiences a problem in that it has many design parameters including, the line width of the lines L1 to L4, the radius of the round conductor C and the shape and size of the stubs S1 and S2, i.e., the stub length and the stub width, resulting in a high level of difficulty in its design. Moreover, changes in the directional coupler characteristics are highly susceptible to errors in the pattern accuracy of the stubs S1 and S2, the round conductor C, and the lines L1 to L4, that is, high pattern accuracy is required for the desired electrical characteristics. It is therefore difficult to form a conductor pattern on a dielectric substrate using, for example, a thick film printing technique.

SUMMARY OF THE INVENTION

Accordingly, it is an object of the present invention to provide a directional coupler capable of achieving desired directional coupler characteristics and is less susceptible to changes in the electrical characteristics due to variations in the sizes of a conductor pattern formed on a substrate. The conductor pattern is produced by, for example, a low-cost technique such as a thick film printing technique. It is another object of the present invention to provide a directional coupler of simple design with fewer design parameters.

In one aspect, the present invention provides a directional coupler including a substrate and a conductor pattern. The conductor pattern includes first to fourth lines formed on the substrate, and first and second conductive pattern portions. The first to fourth lines extend radially from a predetermined point on the substrate, and each line has a first point on a center line thereof extending in the longitudinal direction, the first point being a first distance from the predetermined point. The first conductive pattern portion is defined by the first and second lines and a first connecting line that connects the first point of the first line and the first point of the second line. The first connecting line is a curve, a straight line, or a bent line having an inner angle equal to or more than 90° and less than 180°, and the crossing angle defined between the first connecting line and edges of the first and second lines is equal to or more than 90° and equal to or less than 180°. The second conductive pattern portion is defined by the third and fourth lines and a second connecting line that connects the first point of the third line and the first point of the fourth line. The second connecting line is a curve, a straight line, or a bent line having an inner angle equal to or more than 90° and less than 180°, and the crossing angle defined between the second connecting line and edges of the third and fourth lines is equal to or more than 90° and equal to or less than 180°.

The conductor pattern may further include third and fourth conductive pattern portions. Each of the first to fourth lines may have a second point on the center line thereof extending in the longitudinal direction, and the second point may be a second distance from the predetermined point, wherein the second distance is different from the first distance. The third conductive pattern portion may be defined by the second and third lines and a third connecting line that connects the second point of the second line and the second point of the third line. The third connecting line may be a curve, a straight line, or a bent line having an inner angle equal to or more than 90° and less than 180°, and the crossing angle defined between the third connecting line and edges of the second and third lines may be equal to or more than 90° and equal to or less than 180°. The fourth conductive pattern portion may be defined by the fourth and first lines and a fourth connecting line that connects the second point of the fourth line and the second point of the first line. The fourth connecting line may be a curve, a straight line, or a bent line having an inner angle equal to or more than 90° and less than 180°, and the crossing angle defined between the fourth connecting line and edges of the fourth and first lines may be equal to or more than 90° and equal to or less than 180°.

In another aspect, the present invention provides a directional coupler including a substrate and a conductor pattern. The conductor pattern includes first to fourth lines formed on the substrate, and first and second conductive pattern portions. The first to fourth lines extend radially from a predetermined point on the substrate, and each line has a first point. The first points of the first and second lines are a first distance from a corner of the first and second lines along edges of the first and second lines, and the first points of the third and fourth lines are the first distance from a corner of the third and fourth lines along edges of the third and fourth lines. The first conductive pattern portion is defined by the first and second lines and a first connecting line that connects the first point of the first line and the first point of the second line. The first connecting line is a curve, a straight line, or a bent line having an inner angle equal to or more than 90° and less than 180°, and the crossing angle defined between the first connecting line and edges of the first and second lines is equal to or more than 90° and equal to or less than 180°. The second conductive pattern portion is defined by the third and fourth lines and a second connecting line that connects the first point of the third line and the first point of the fourth line. The second connecting line is a curve, a straight line, or a bent line having an inner angle equal to or more than 90° and less than 180°, and the crossing angle defined between the second connecting line and the third and fourth lines is equal to or more than 90° and equal to or less than 180°.

The conductor pattern may further include third and fourth conductive pattern portions. Each of the first to fourth lines may have a second point. The second points of the second and third lines may be a second distance from a corner of the second and third lines along edges of the second and third lines, and the second points of the fourth and first lines may be the second distance from a corner of the fourth and first lines along edges of the fourth and first lines, wherein the second distance is different from the first distance. The third conductive pattern portion may be defined by the second and third lines and a third connecting line that connects the second point of the second line and the second point of the third line. The third connecting line may be a curve, a straight line, or a bent line having an inner angle equal to or more than 90° and less than 180°, and the crossing angle defined between the third connecting line and edges of the second and third lines may be equal to or more than 90° and equal to or less than 180°. The fourth conductive pattern portion may be defined by the fourth and first lines and a fourth connecting line that connects the second point of the fourth line and the second point of the first line. The fourth connecting line may be a curve, a straight line, or a bent line having an inner angle equal to or more than 90° and less than 180°, and the crossing angle defined between the fourth connecting line and edges of the fourth and first lines may be equal to or more than 90° and equal to or less than 180°.

Accordingly, the first to fourth lines radially extend from the predetermined point, thus causing a plurality of degenerate resonant modes around the predetermined point. The degeneracy of the plurality of resonant modes is broken by the first and second conductive pattern portions. Alternatively, the degeneracy of the plurality of resonant modes is broken by the first and second conductive pattern portions whose size is different from that of the third and fourth conductive pattern portions. The first and second distances are designed so that the plurality of resonant modes are cancelled (therefore, no signal is output) or strengthened (therefore, a signal is output) at the ports, thus achieving a directional coupler having the desired characteristics.

The conductor pattern may have a double mirror-image geometry having two symmetry planes that extend through the predetermined point.

An angle defined between two adjacent lines of the first to fourth lines may be substantially a right angle.

In still another aspect, the present invention provides a high-frequency circuit device including the directional coupler.

According to the present invention, since there is no acute portion in the conductor pattern in the resonance region formed of the first to fourth conductive portions and the first to fourth lines, the configuration of the conductor pattern in the resonance region does not change as the size of the conductive pattern portions varies. Changes in the characteristics of the directional coupler are therefore less susceptible to variations in the dimensions of the conductor pattern, and the directional coupler can be produced using a low-cost manufacturing technique such as thin film printing.

Furthermore, according to the present invention, degeneracy of resonant modes that occur around a predetermined point is broken by appropriately determining the first distance that defines the sizes of the first to fourth conductive pattern portions or appropriately determining the first and second distances. The design parameters required to achieve the desired directional coupler characteristics are the first and second distances, and the line width. Thus, a directional coupler of simple design with low design cost is achieved.

Furthermore, according to the present invention, the conductor pattern preferably has a double mirror-image geometry having two symmetry planes that extend through a predetermined point from which the first to fourth lines radially extend, and an angle defined between two adjacent lines of these four lines is substantially a right angle, thus realizing an ideal 4-port circuit. In this directional coupler, a matched port is positively isolated from another port, resulting in high directivity.

Furthermore, according to the present invention, a high-frequency circuit device including the directional coupler described above can be produced at low cost.

BRIEF DESCRIPTION OF THE DRAWINGS

FIG. 8 is a table showing the values of the results shown in FIG. 7;

DESCRIPTION OF THE PREFERRED EMBODIMENTS

Figure 14A:
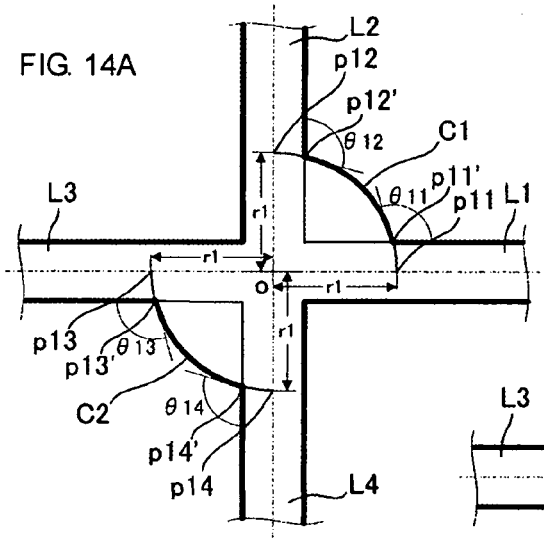
FIGS. 14A to 14D are illustrations of a conductor pattern of a directional coupler according to the present invention.

FIG. 14A shows a conductor pattern of a directional coupler according to the present invention. In FIG. 14A, first to fourth lines L1 to L4 radially extend from a predetermined point o, and points p11 to p14 are positioned so as to be a distance r1 from the point o. A connecting line C1 that connects the point p11 and the point p12 constitutes an arc centered on the point o. A first conductive pattern portion R1 is defined by the lines L1 and L2 and the connecting line C1. A connecting line C2 that connects the point p13 and the point p14 also constitutes an arc centered on the point o. A second conductive pattern portion R2 is defined by the lines L3 and L4 and the connecting line C2.

An intersection p11' between the first connecting line C1 and an edge of the first line L1 has a crossing angle θ11 equal to or more than 90°, and an intersection p12' between the first connecting line C1 and an edge of the second line L2 has a crossing angle θ12 equal to or more than 90°. An intersection p13' between the second connecting line C2 and an edge of the third line L3 has a crossing angle θ13 equal to or more than 90°, and an intersection p14' between the second connecting line C2 and an edge of the fourth line L4 has a crossing angle θ14 equal to or more than 90°.

Figure 14B:
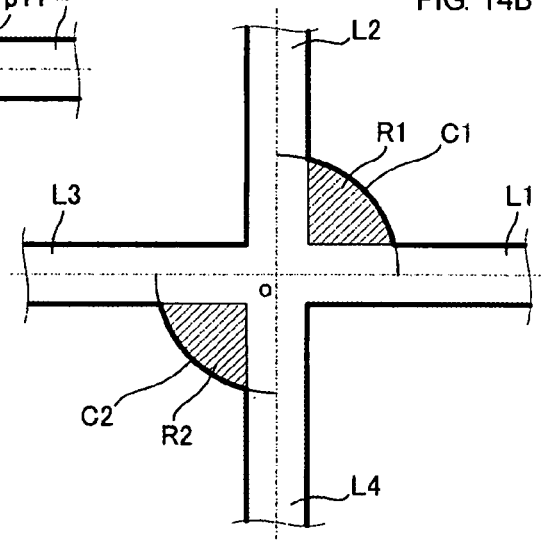

The first and second conductive pattern portions R1 and R2 are hatched in FIG. 14B.

Figure 14C:
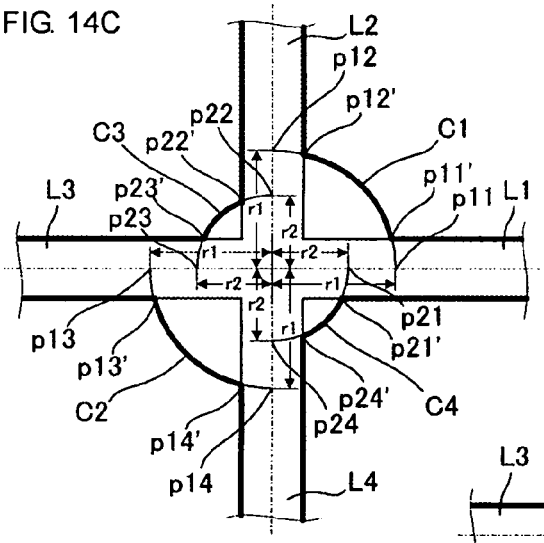

In FIG. 14C, points p21 to p24 are positioned so as to be a distance r2 from the point o from which the first to fourth lines L1 to L4 radially extend. A connecting line C3 that connects the point p22 and the point p23 constitutes an arc centered on the point o. A third conductive pattern portion R3 is defined by the lines L2 and L3 and the connecting line C3. A connecting line C4 that connects the point p24 and the point p21 constitutes an arc centered on the point o. A fourth conductive pattern portion R4 is defined by the lines L4 and L1 and the connecting line C4. The distance r2 has a value different from the distance r1.

An intersection p22' between the third connecting line C3 and an edge of the second line L2 has a crossing angle equal to or more than 90°, and an intersection p23' between the third connecting line C3 and an edge of the third line L3 has a crossing angle equal to or more than 90°. An intersection p24' between the fourth connecting line C4 and an edge of the fourth line L4 has a crossing angle equal to or more than 90°, and an intersection p21' between the fourth connecting line C4 and an edge of the first line L1 has a crossing angle equal to or more than 90°. For ease of illustration, these crossing angles are not shown in FIG. 14C.

Figure 14D:
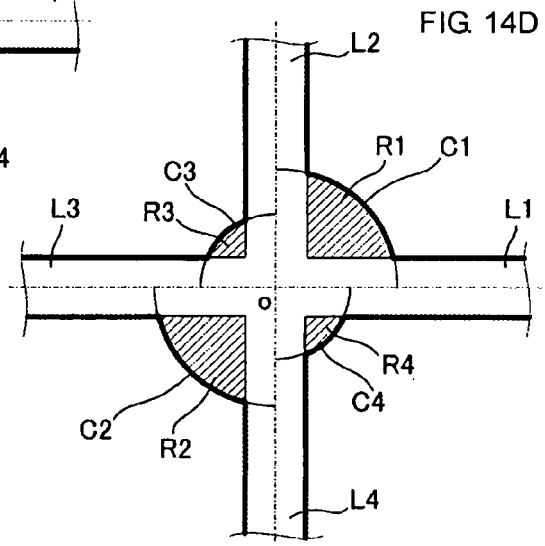

The third and fourth conductive pattern portions R3 and R4 are hatched in FIG. 14D.

Figure 15A:
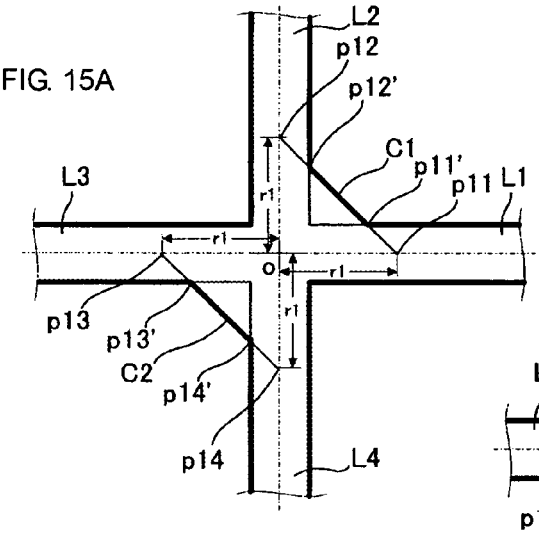
FIGS. 15A and 15B are illustrations of another conductor pattern of the directional coupler according to the present invention.

FIG. 15A shows a conductor pattern as a modification. In this conductor pattern, the point p11 and the point p12 are connected by a straight line C1, and the point p13 and the point p14 are connected by a straight line C2. In FIG. 15B, the point p22 and the point p23 are connected by a straight line C3, and the point p24 and the point p21 are connected by a straight line C4.

Figure 15C:
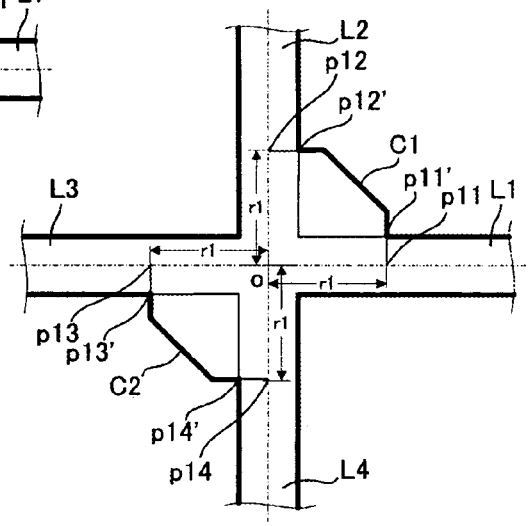
FIGS. 15C and 15D are illustrations of another conductor pattern of the directional coupler according to the present invention.
Figure 15B:
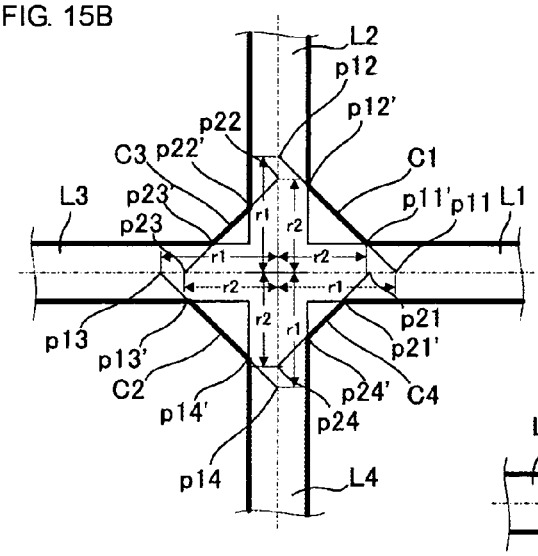
Figure 15D:
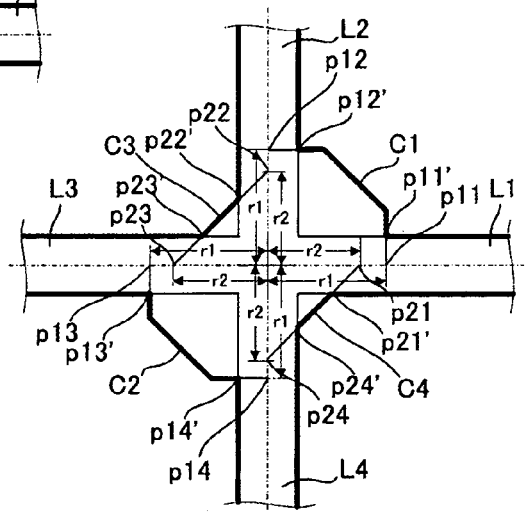

FIG. 15C shows a conductor pattern as a modification. In this conductor pattern, the point p11 and the poet 12 are connected by a bent line C1 whose inner angle is equal or more than 90° and less than 180°, i.e., a right angle or an obtuse angle, and the point p13 and the point p14 are connected by a bent line C2 whose inner angle is equal to or more than 90° and less than 180°, i.e., a right angle or an obtuse angle. The crossing angles defined by the first connecting line Cl and edges of the first and second lines L1 and L2 are each equal to 90°. In FIG. 15D, the point p22 and the point p23 are connected by a straight line C3, and the point p24 and the point p21 are connected by a straight line C4.

Figure 16A:
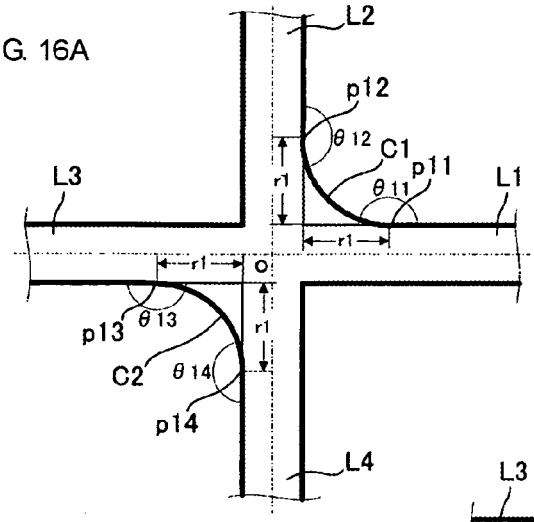
FIGS. 16A to 16D are illustrations of another conductor pattern of the directional coupler according to the present invention.

FIG. 16A shows a conductor pattern of a directional coupler according to the present invention. In FIG. 16A, first and second lines L1 and L2 radially extend from a predetermined point o, and points p11 and p12 are positioned so as to be a distance r1 from a corner of the first and second lines L1 and L2 along edges of the first and second lines L1 and L2, and points p13 and p14 are positioned so as to be the distance r1 from a corner of the third and fourth lines L3 and L4 along edges of the third and fourth lines. A connecting line C1 that connects the point p11 and the point p12 is an arc with a radius r1. Thus, a crossing angle θ11 defined between the first connecting line C1 and the point p11 of the first line L1 is equal to 180°, and a crossing angle θ12 defined between the first connecting line C1 and the point p12 of the second line L2 is equal to 180°. A first conductive pattern portion R1 is defined by the first and second lines L1 and L2 and the connecting line C1. A connecting line C2 that connects the point p13 and the point p14 is an arc with a radius r1. Thus, a crossing angle θ13 defined between the second connecting line C2 and the point p13 of the third line L3 is equal to 180°, and a crossing angle θ14 defined between the second connecting line C2 and the point p14 of the fourth line L4 is equal to 180°. A second conductive pattern portion R2 is defined by the third and fourth lines L3 and L4 and the connecting line C2.

Figure 16B:
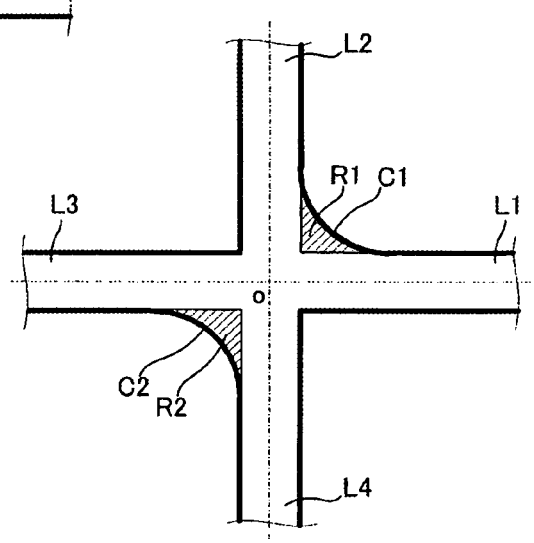

The first and second conductive pattern portions R1 and R2 are hatched in FIG. 16B.

Figure 16C:
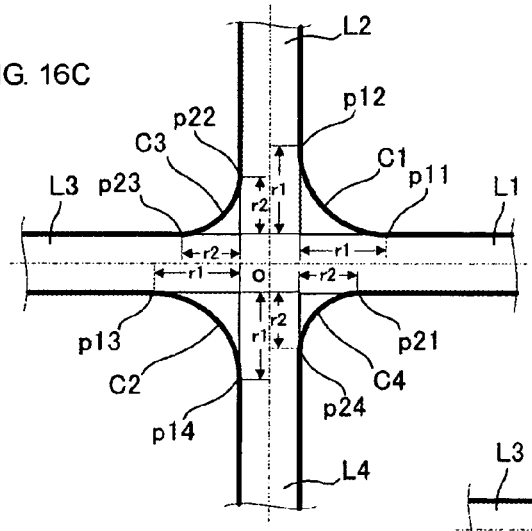

In FIG. 16C, points p22 and p23 are positioned so as to be a distance r2 from a corner of the second and third lines L2 and L3 along edges of the second and third lines L2 and L3, and points p24 and p21 are positioned so as to be the distance r2 from a corner of the fourth and first lines L4 and L1 along edges of the fourth and first lines L4 and L1. A connecting line C3 that connects the point p22 and the point p23 is an arc with a radius r2. A third conductive pattern portion R3 is defined by the second and third lines L2 and L3 and the connecting line C3. A connecting line C4 that connects the point p24 and the point p21 is an arc with a radius r2. A fourth conductive pattern portion R4 is defined by the fourth and first lines L4 and L1 and the connecting line C4. The distance r2 has a value different from the distance r1.

Figure 16D:
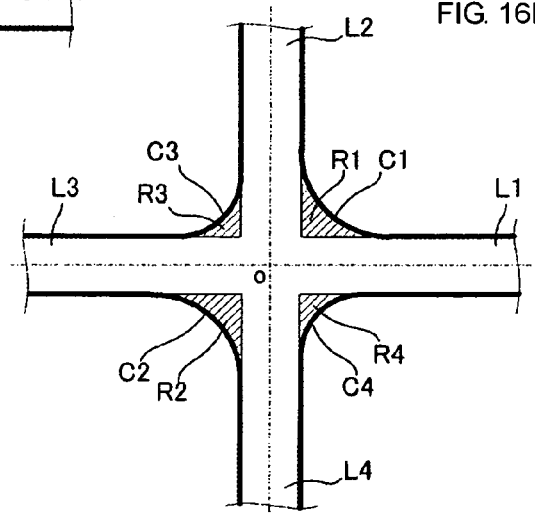
Figure 17:
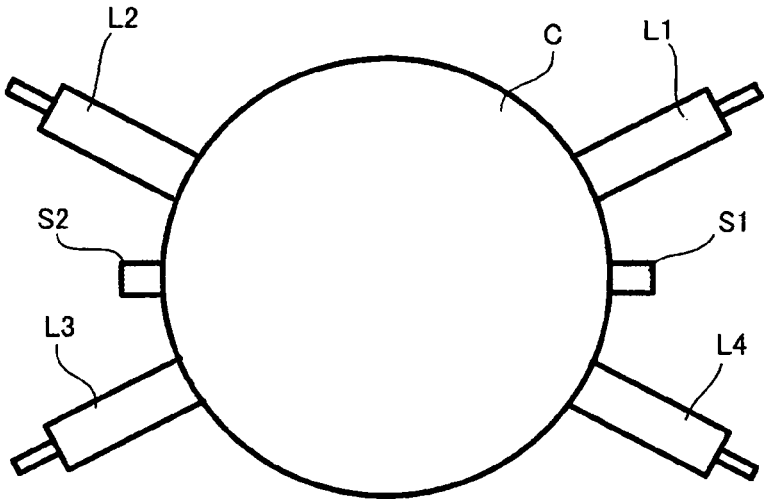
FIG. 17 PRIOR ART
FIG. 17 is an illustration of a directional coupler of the related art.

The third and fourth conductive pattern portions R3 and R4 are hatched in FIG. 16D.

A directional coupler according to a first preferred embodiment of the present invention will be described with reference to FIGS. 1A to 5D.

Figure 1A:
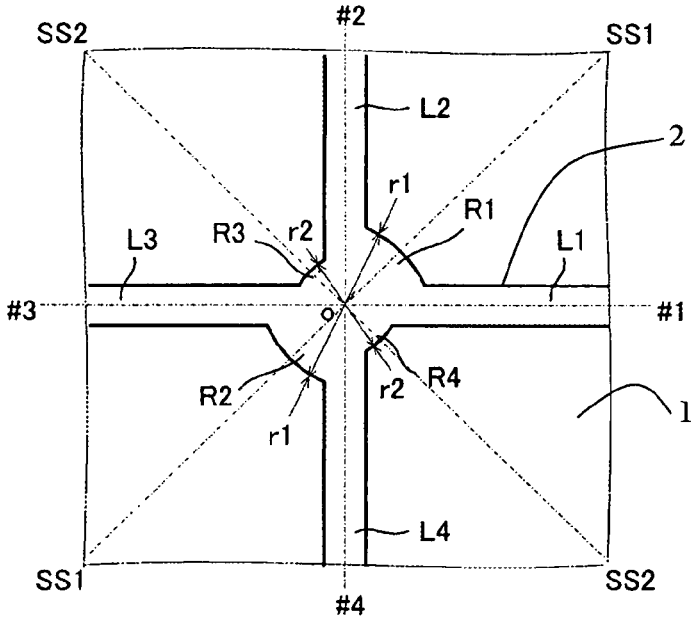
FIG. 1A is a top view of a directional coupler according to a first preferred embodiment of the present invention.
Figure 1B:
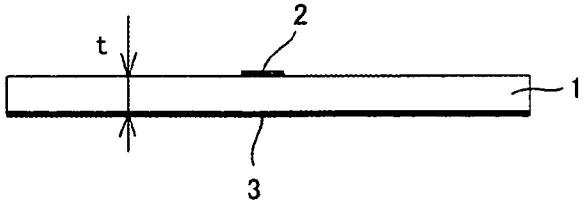
FIG. 1B is a front view of the directional coupler.

FIGS. 1A and 1B are a top view and a front view of the directional coupler, respectively. A conductor pattern 2 is formed on the top surface of a substrate 1. A ground conductor 3 is formed on the opposite surface of the substrate 1 so as to cover the entirety of this surface. As shown in FIG. 1A, the conductor pattern 2 on the top surface includes first to fourth lines L1 to L4 and first to fourth conductive pattern portions R1 to R4. The conductor pattern 2 has the structure shown in FIG. 14C.

In the conductor pattern 2, a right angle is defined between two adjacent lines of the first to fourth lines L1 to L4. A first symmetry plane SS1 extending through the center o resides between the lines L1 and L2 and between the lines L3 and L4. A second symmetry plane SS2 extending through the center o resides between the lines L2 and L3 and between the lines L4 and L1. Thus, the conductor pattern 2 formed of the first to fourth lines L1 to L4 and the first to fourth conductive pattern portions R1 to R4 has a so-called double mirror-image geometry.

Figure 2A:
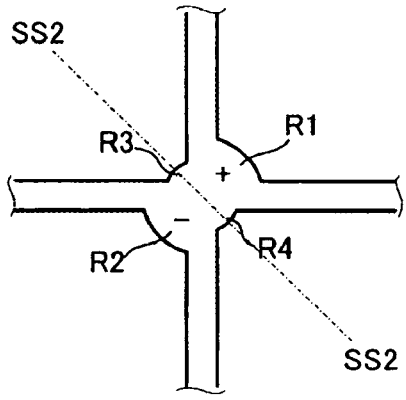
FIGS. 2A to 2D are illustrations of a plurality of resonant modes caused in the directional coupler.
Figure 2B:
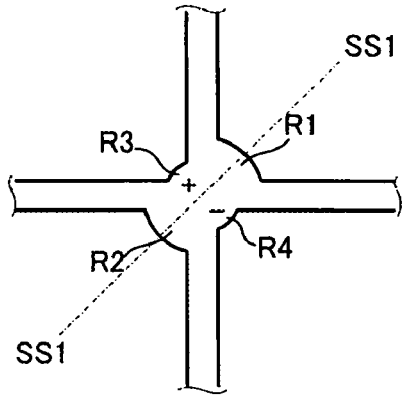
Figure 2C:
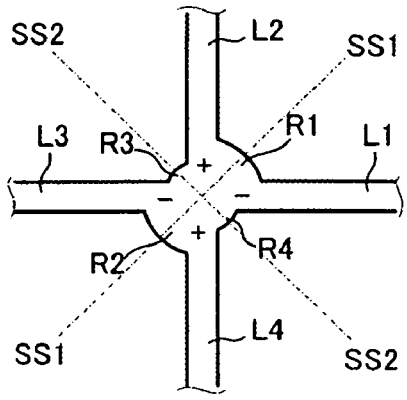
Figure 2D:
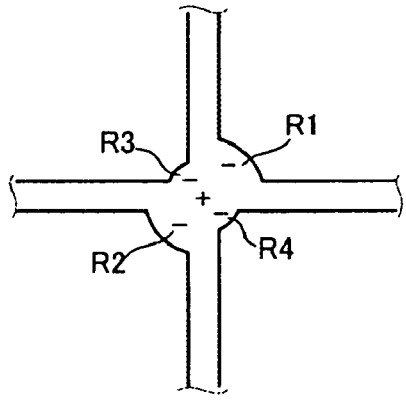

FIGS. 2A to 2D show a plurality of resonant modes caused around the center o shown in FIG. 1A. In FIGS. 2A to 2D, symbols "+" and "−" represent the polarity of the electric field vector vertical to the substrate. FIG. 2A shows a resonant mode whose symmetry plane is the second symmetry plane SS2, that is, an odd resonant mode with respect to the symmetry plane SS2, in which electric field vectors having opposite polarities occur in the conductive pattern portions R1 and R2. FIG. 2B shows a resonant mode whose symmetry plane is the first symmetry plane SS1, that is, an odd resonant mode with respect to the symmetry plane SS1, in which electric field vectors having opposite polarities occur in the conductive pattern portions R3 and R4. FIG. 2C shows a resonant mode in which the two modes shown in FIGS. 2A and 2B are combined. For example, when a positive (+) electric field vector occurs at the "root" of the lines L2 and L4, a negative (−) electric field vector occurs at the "root" of the lines L1 and L3. FIG. 2D shows a higher resonant mode, in which opposite-polarity electric field vectors occur in the center and the circumference of an area defined by the conductive pattern portions R1 to R4.

If the resonance regions R1 to R4 have the same size, the plurality of resonant modes are degenerate. However, as shown in FIGS. 2A to 2D, when the size of the resonance regions R1 and R2 symmetric to the second symmetry plane SS2 is made different from the size of the resonance regions R3 and R4 symmetric to the first symmetry plane SS1, degeneracy of the resonant modes is broken.

While the four resonance regions R1 to R4 are formed in this example, the third and fourth resonance regions R3 and R4 may be removed. In this case, a plurality of resonant modes occur in the manner described above because an area around the center o has a certain size. The resonance regions R1 and R2 break the degeneracy of the resonant modes.

FIGS. 3A to 3D show characteristic changes when the dimensions of the directional coupler shown in FIGS. 1A and 1B vary. It is assumed herein that the line widths w of the first to fourth lines L1 to L4 are each 0.23 mm, the relative dielectric constant of the substrate 1 is 9.05, and the thickness t of the substrate 1 is 0.2 mm.

Figure 3A:
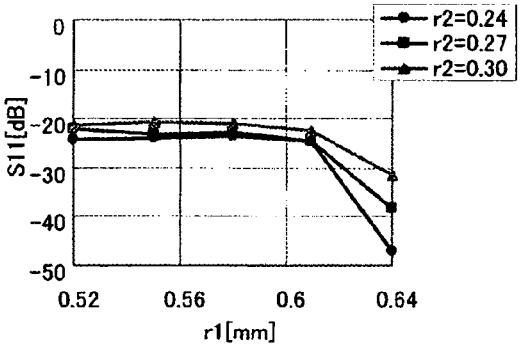
FIGS. 3A to 3D are characteristic charts showing four S-parameter characteristics of the directional coupler when two parameters r1 and r2 vary.
Figure 3B:
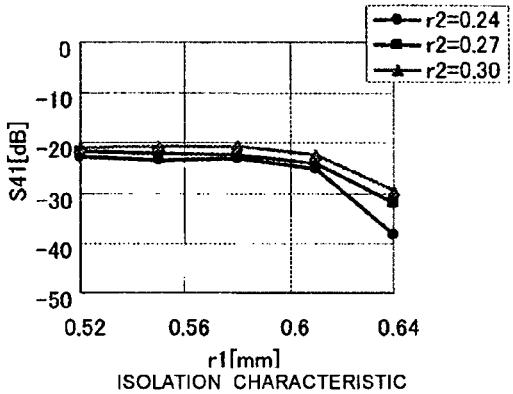
Figure 3C:
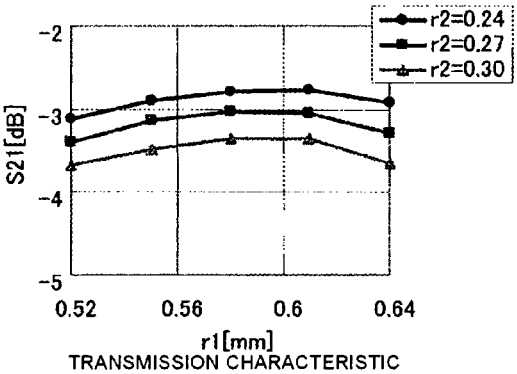
Figure 3D:
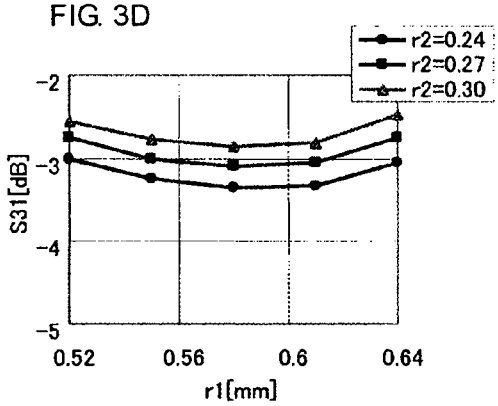

In FIGS. 3A to 3D, r2 is 0.24 mm, 0.27 mm, and 0.3 mm, with r1 shown on the x-axis and the amount of attenuation on the y-axis. FIG. 3A shows a reflection characteristic S11 at a port #1, FIG. 3B shows a transmission characteristic S21 from the port #1 to a port #2, FIG. 3C shows an isolation characteristic S41 between the port #1 and a port #4, and FIG. 3D shows a transmission characteristic S31 from the port #1 to a port #3. Therefore, a directional coupler characteristic in which a signal input from the port #1 is passed to the ports #2 and #3 while it is not passed to the port #4 is achieved. Moreover, the characteristic is stable across a relatively wide range of r1 and r2.

In this example, the characteristics S21 and S31 exhibit −3.0 dB when r1=0.565 and r2=0.27, achieving a 3-dB coupler.

Figure 4A:
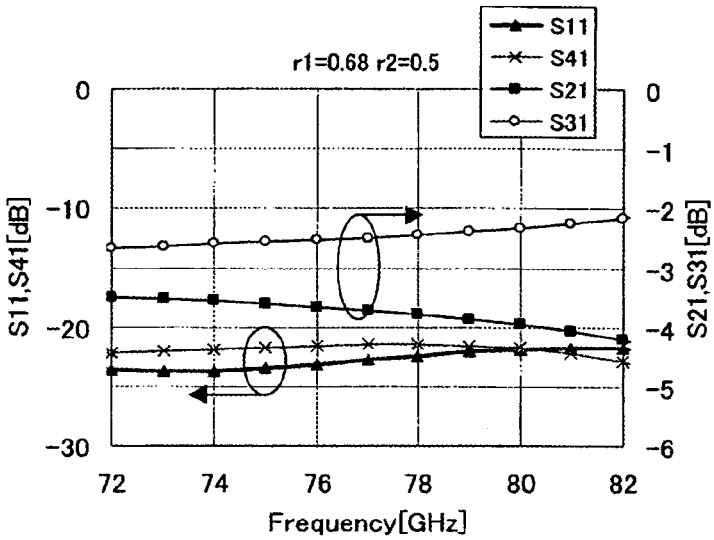
FIGS. 4A to 4C are characteristic charts showing the frequency characteristic of the directional coupler.

FIG. 4A is a characteristic that is designed for a 3-dB coupler in the 76.5 GHz band. In order to obtain the characteristic shown in FIG. 4A, the relative dielectric constant of the substrate 1 is 4.0, r1 is 0.68 mm, and r2 is 0.5 mm. As shown in FIG. 4A, power is halved across a frequency bandwidth as broad as 72 to 82 GHz with low insertion loss and with −20 dB or more isolation from the isolation port.

Figure 4B:
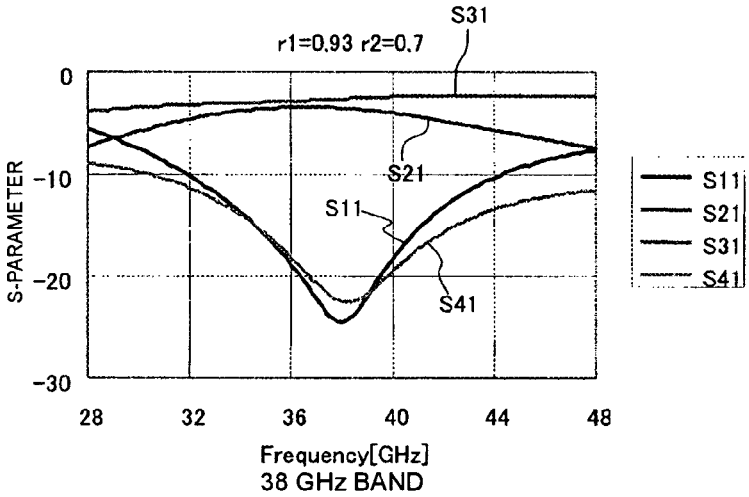

FIG. 4B is an example design for a 3-dB coupler in the 38 GHz band, in which r1=0.93 mm and r2=0.7 mm. In this example, −20 dB isolation is maintained across 36 to 40 GHz.

Figure 4C:
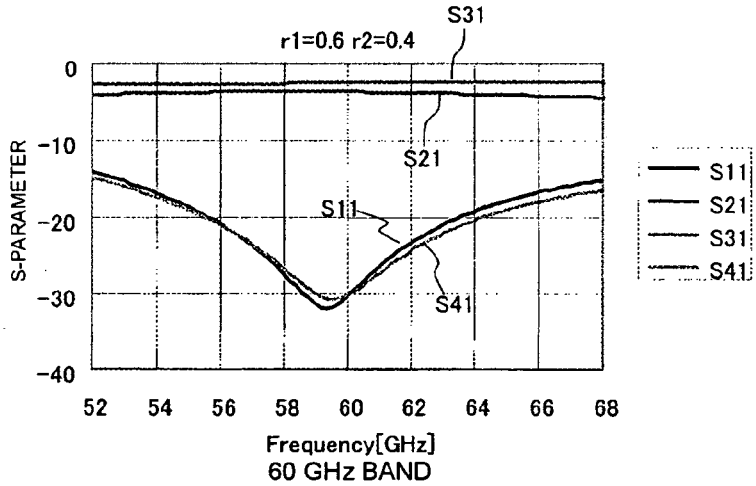

FIG. 4C is an example design for a 3-dB coupler in the 60 GHz band, in which r1=0.6 mm and r2=0.4 mm. In this example, −20-dB isolation is maintained across 56 to 64 GHz.

A directional coupler according to a second preferred embodiment of the present invention will now be described with reference to FIGS. 5A to 5D.

Figure 5A:
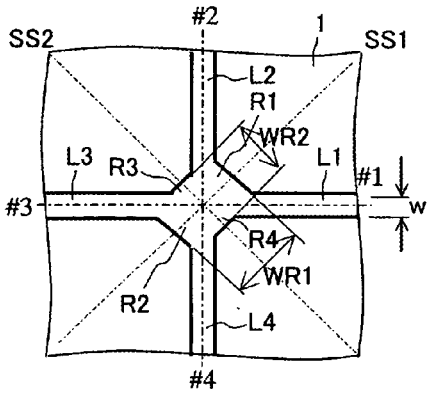
FIGS. 5A and 5C are illustrations of a directional coupler according to a second preferred embodiment of the present invention.

The directional coupler according to the second preferred embodiment includes a conductor pattern having the configuration shown in FIGS. 15A and 15B. FIG. 5A is a top view of this directional coupler including such a conductor pattern on the top surface of a dielectric substrate 1. The conductor pattern has first to fourth lines L1 to L4, and first to fourth conductive pattern portions R1 to R4. A ground conductor is formed on the opposite surface of the substrate 1 so as to cover the entirety of this surface. As shown in FIG. 15B, the sizes of the conductive pattern portions R1 to R4 are determined by points p11, p12, p13, and p14 a distance r1 from the center o and points p21, p22, p23, and p24 a distance r2 from the center o. In the example shown in FIG. 5A, the sizes of the conductive pattern portions R1 to R4 are determined by a width WR1 parallel to a first symmetry plane SS1 of the conductive pattern portions R1 and R2 and a width WR2 parallel to a second symmetry plane SS2 of the conductive pattern portions R3 and R4.

Figure 5B:
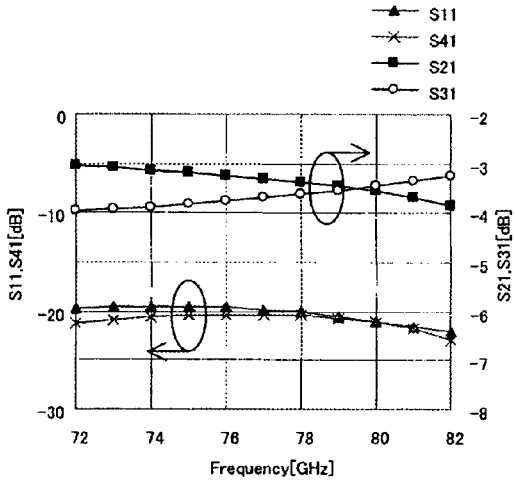
FIGS. 5B and 5D are characteristic charts showing the frequency characteristic of the directional coupler.

FIG. 5B shows the S-parameters of the directional coupler where the relative dielectric constant of the substrate 1 is 9.05, the thickness of the substrate 1 is 0.2 mm, the line width of each of the lines L1 to L4 is 0.23 mm, WR1=1.10 mm, and WR2=0.38 mm.

Figure 5C:
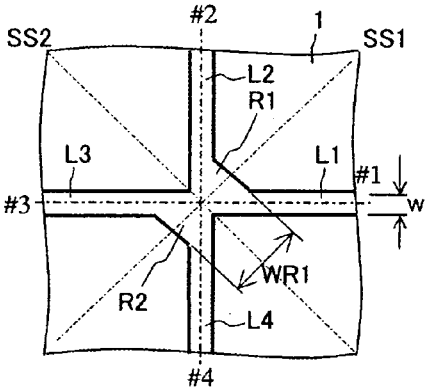
Figure 5D:
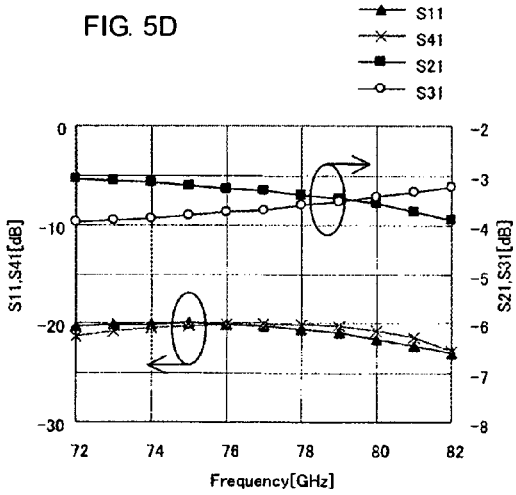

FIG. 5C is a top view of a directional coupler having the structure shown in FIG. 15A, and this directional coupler includes the first and second conductive pattern portions R1 and R2, wherein WR1=1.10 mm. FIG. 5D depicts four S-parameters of the directional coupler shown in FIG. 5C.

In either directional coupler shown in FIG. 5A or 5C, an incoming signal from the port #1 is passed to the ports #2 and #3, while the ports #1 and #4 are isolated from each other. Moreover, either directional coupler acts as a directional coupler in a broad frequency bandwidth around a designed center frequency of 76.5 GHz.

The directional coupler of the present invention whose characteristic changes are less susceptible to variations in the dimensions of the conductor pattern than a directional coupler of the related art will now be described with reference to FIGS. 6A to 9F.

Figure 6A:
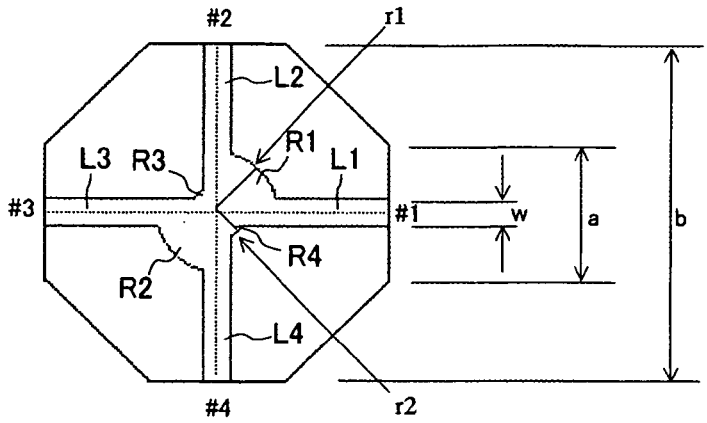
FIGS. 6A and 6B are illustrations of a directional coupler according to a third preferred embodiment of the present invention.
Figure 6B:
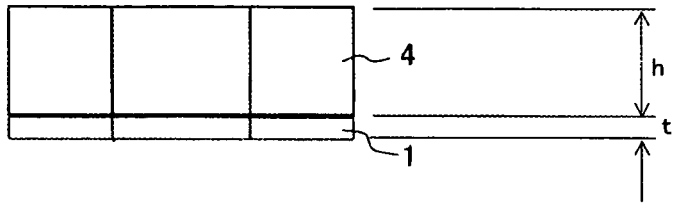
Figure 6C:
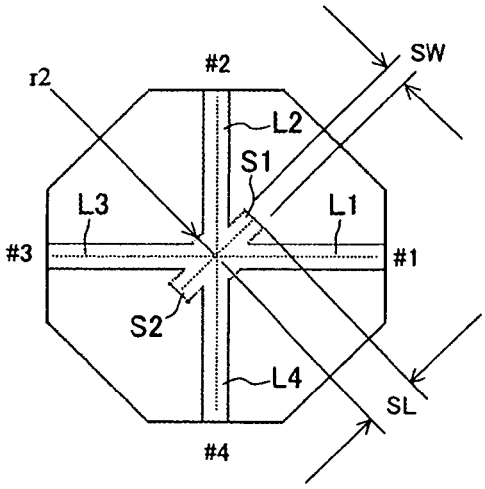
FIG. 6C PRIOR ART
FIGS. 6C and 6D are illustrations of a directional coupler of a comparative example.
Figure 6D:
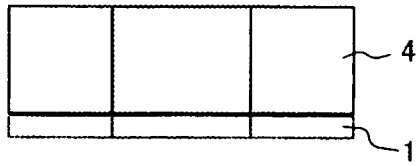
FIG. 6D PRIOR ART

FIGS. 6A and 6B are a top view and a front view of a directional coupler according to a third preferred embodiment of the present invention, respectively. FIGS. 6C and 6D are a top view and a front view of a directional coupler of the related art as a comparative example, respectively. The surface of the substrate 1 is covered by a cover 4. The cover 4 serves to determine the boundary conditions in simulation.

Figure 7A:
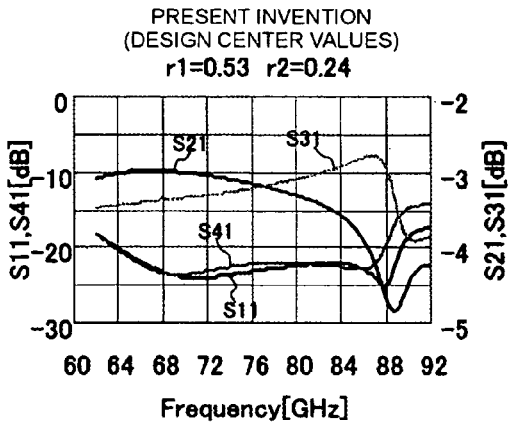
FIGS. 7A to 7F are characteristic charts showing frequency characteristic changes of the directional coupler of the present invention and the directional coupler of the comparative example as the configuration of the conductor pattern varies.
Figure 7D:
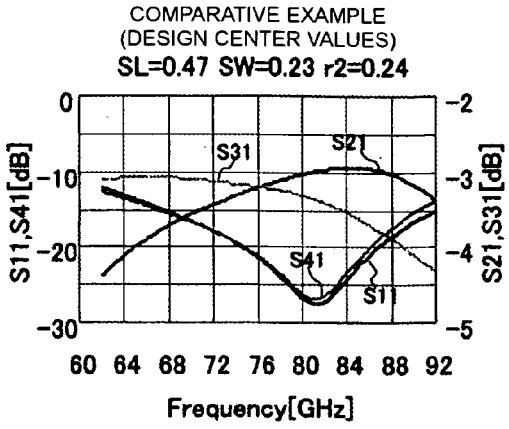
Figure 7B:
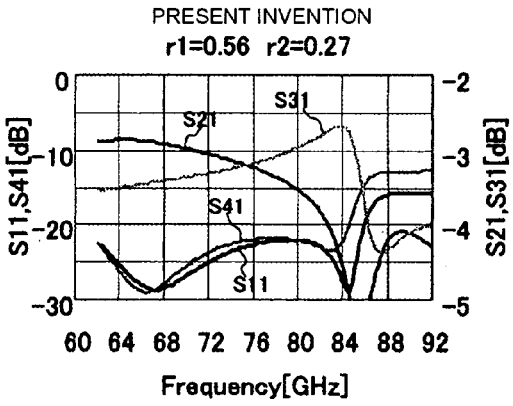
Figure 7E:
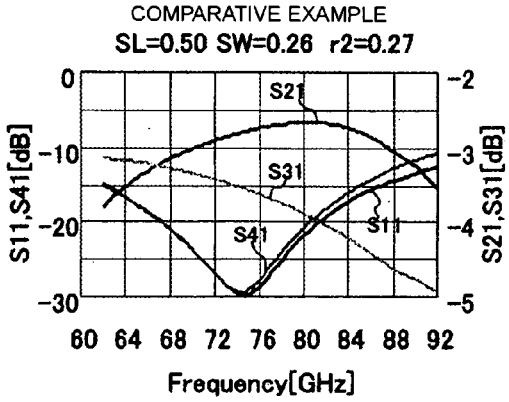
Figure 7C:
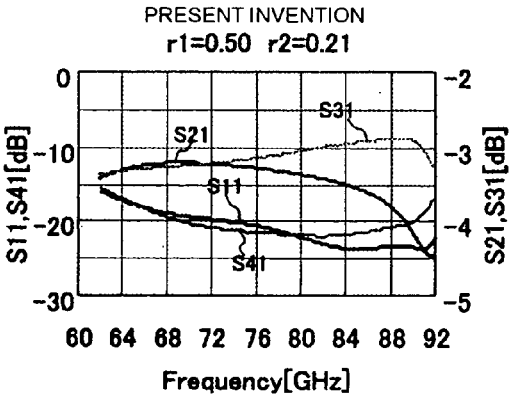
Figure 7F:
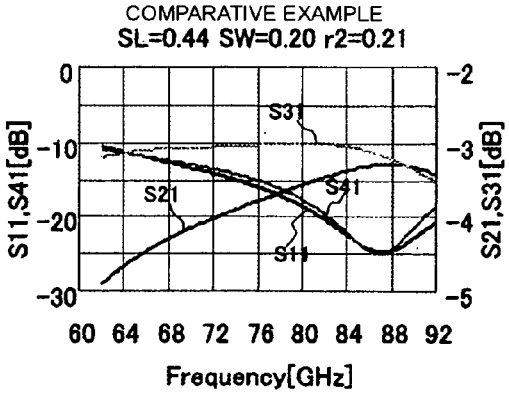

FIGS. 7A to 7C show the characteristics of four S-parameters of the directional coupler shown in FIG. 6A as the dimensions of the conductor pattern vary. FIGS. 7D to 7F show the characteristics of four S-parameters of the directional coupler shown in FIG. 6B as the dimensions of the conductor pattern vary.

The following are the dimensions of the directional coupler shown in FIG. 6A expressed in mm:

t=0.2
h=1.0
r1=0.53
r2=0.24
w=0.23
a=1.2
b=3.0

The relative dielectric constant of the substrate 1 is 9.05.

The following are the dimensions of the directional coupler shown in FIG. 6B expressed in mm:

SW=0.23
SL=0.47

The other dimensions are the same as those noted above.

FIG. 7A shows the characteristics of the directional coupler of the present invention having r1=0.53 mm and r2=0.24 mm as design center values. FIG. 7B shows the characteristics of a directional coupler of the present invention in which the conductor pattern is 0.03 mm thicker than the design center values, and FIG. 7C shows the characteristics of a directional coupler of the present invention in which the conductor pattern is 0.03 mm thinner than the design center values. As can be seen from FIGS. 7A to 7C, even when the configuration of the conductor pattern varies, the characteristics S21 and S31 exhibit lower than −3 dB and the characteristics S11 and S41 exhibit lower than −20 dB at a design frequency of 76.5 GHz. Therefore, the directional coupler of the present invention exhibits stable 3-dB coupler characteristics.

FIG. 7D shows the characteristics of the directional coupler of the comparative example having SL=0.47 mm, SW=0.23 mm, and r2=0.24 mm as design center values. FIG. 7E shows the characteristics of a directional coupler of the comparative example in which the conductor pattern is 0.03 mm thicker than the design center values, and FIG. 7F shows the characteristics of a directional coupler of the comparative example in which the conductor pattern is 0.03 mm thinner. As shown in FIG. 7D, the characteristics S21 and S31 exhibit lower than −3 dB and the characteristics S11 and S41 exhibit lower than −20 dB when the directional coupler has the design center values. However, when the conductor pattern becomes thin or thick, as can be seen from FIGS. 7E and 7F, the difference between the characteristics S21 and S31 is large and the attenuation center frequency for the characteristics S11 and S41 is shifted.

FIG. 8 is a table showing the result values as the characteristics change.

Figure 9A:
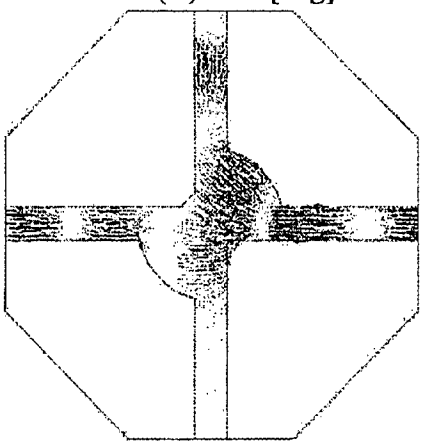
FIGS. 9A to 9F are current vectors in the conductor pattern of the directional coupler of the present invention and the directional coupler of the comparative example.
Figure 9B:
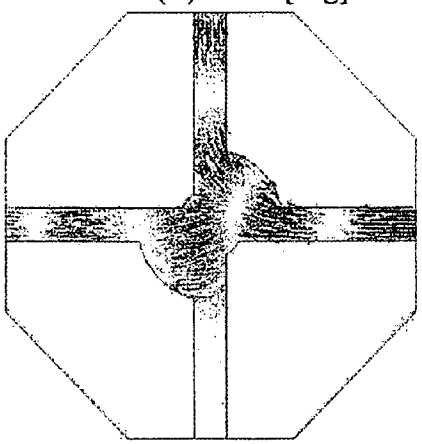
Figure 9C:
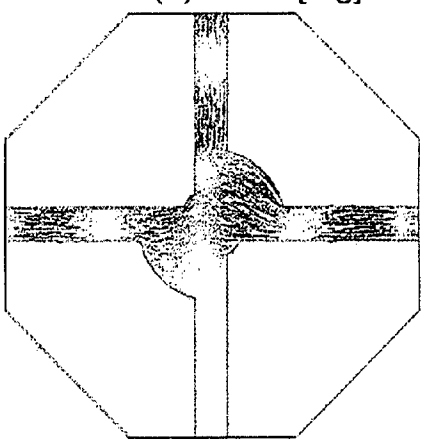
Figure 9D:
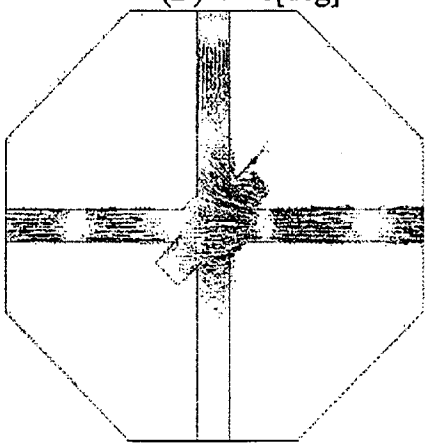
Figure 9E:
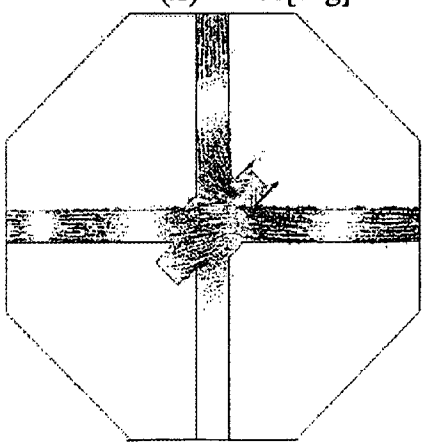
Figure 9F:
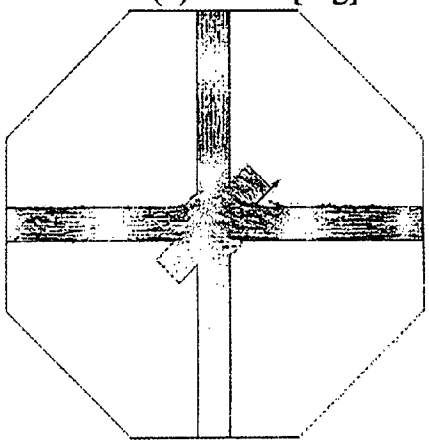

The analysis of the difference in susceptibility of a characteristic change to variations in the configuration of the conductor pattern will be described with reference to FIGS. 9A to 9F, showing the vectors of currents flowing in the lines. FIGS. 9A to 9C show the vectors of currents flowing in the conductor pattern of the directional coupler of the present invention shown in FIG. 6A. FIGS. 9D to 9F show the vectors of currents flowing in the conductor pattern of the directional coupler of the comparative example (related art) shown in FIG. 6B. In FIGS. 9A to 9F, the phase angle of a propagating signal is indicated by θ, and the magnitude is indicated by the density of the current vectors.

As is apparent from FIGS. 9D to 9F, in the directional coupler of the comparative example, the "roots" of the stubs S1 and S2 with respect to the lines L1 to L4 are acute, as shown in FIG. 6B, and the current is therefore concentrated in the acute portions. Such acute portions are most affected by variations in the configuration of the conductor pattern. That is, as the overall conductor pattern becomes thin or thick, there is a noticeable change in the pattern in these portions. In the comparative example, therefore, the susceptibility of a characteristic change due to variations in the configuration of the conductor pattern is high.

In the directional coupler of the present invention, in contrast, the crossing angles defined by the "roots" of the conductor patterns R1 to R4 and the lines L1 to L4 shown in FIG. 6A are obtuse, and thus the current is not concentrated in these portions. The obtuse portions are not readily affected by variations in the configuration of the conductor pattern, and the susceptibility of a characteristic change due to variations in the configuration of the conductor pattern is therefore low.

Accordingly, a low-cost manufacturing method, such as thick film printing, which results in some variations in the pattern width can be used to produce a conductor pattern, thus easily achieving a directional coupler having desired characteristics.

A directional coupler according to a fourth preferred embodiment of the present invention will now be described with reference to FIGS. 10A to 11B.

Figure 10A:
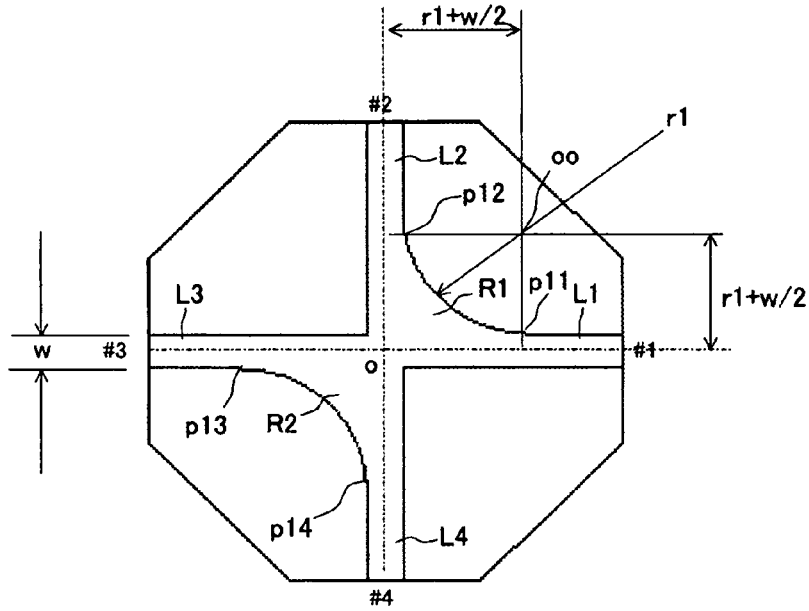
FIG. 10A is an illustration of a directional coupler according to a fourth preferred embodiment of the present invention.

The directional coupler shown in FIG. 10A has the structure shown in FIGS. 16A and 16B. That is, a connecting line that connects the points p11 and p12 the distance r1 from the corner of the lines L1 and L2 is curved towards the center o. In FIG. 10A, this connecting line constitutes an arc centered on a point o with a radius r1. A conductive pattern portion R1 is formed in a region bounded by this curve and the lines L1 and L2.

Figure 10B:
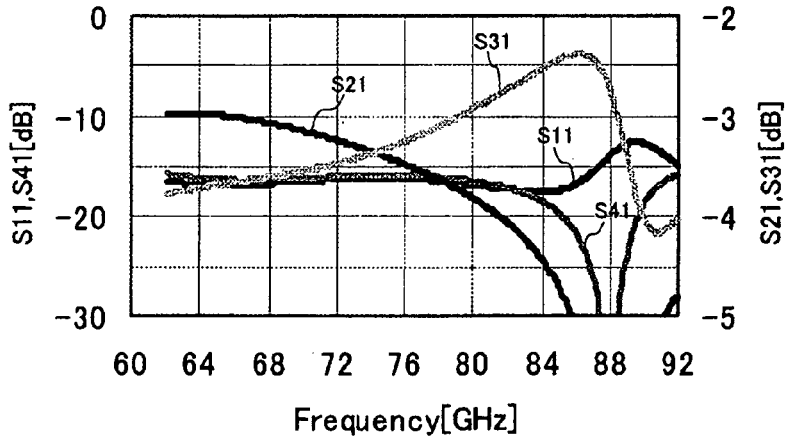
FIG. 10B is a characteristic chart showing the characteristics of the directional coupler.

FIG. 10B shows the four S-parameters of the directional coupler shown in FIG. 10A. In this example, w=0.23 mm and r1=0.8 mm. The relative dielectric constant of the substrate is 9.07, the thickness of the substrate is 0.2 mm, and the height of the cover is 1.0 mm.

As shown in FIG. 10B, also in a directional coupler whose central conductor has the pattern described above, an incoming signal from the port #1 is passed to the ports #2 and #3 while the ports #1 and #4 are isolated from each other.

Figure 11A:
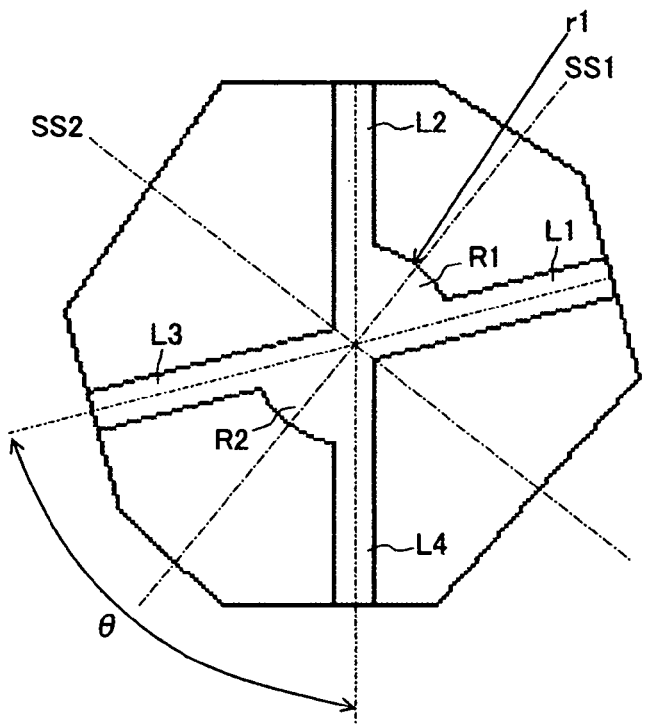
FIG. 11A is an illustration of another directional coupler according to the fourth preferred embodiment.
Figure 11B:
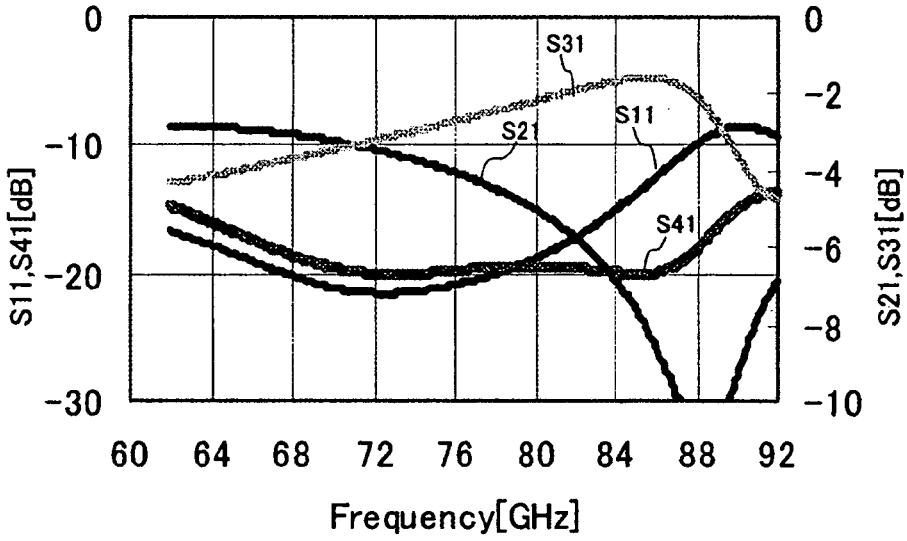
FIG. 11B is a characteristic chart showing the characteristics of the directional coupler.

FIG. 11A shows a directional coupler in which the crossing angle θ defined between adjacent lines of the four lines L1 to L4 is not 90°. The directional coupler shown in FIG. 11A basically has the structure shown in FIG. 6A, but r2=0. In this structure of the directional coupler, the conductor pattern has a double mirror-image geometry so as to be symmetric to a first symmetry plane SS1 and a second symmetry plane SS2. FIG. 11B shows the four parameters of the directional coupler shown in FIG. 11A. In this example, r1=0.58 mm and θ=75°. Other dimensions are the same as those noted above with reference to FIG. 6A.

As shown in FIG. 11B, in a directional coupler having such a pattern, an incoming signal from the port #1 is passed to the ports #2 and #3 while the ports #1 and #4 are isolated from each other.

A directional coupler according to a fifth preferred embodiment of the present invention will now be described with reference to FIGS. 12A and 12B.

Figure 12A:
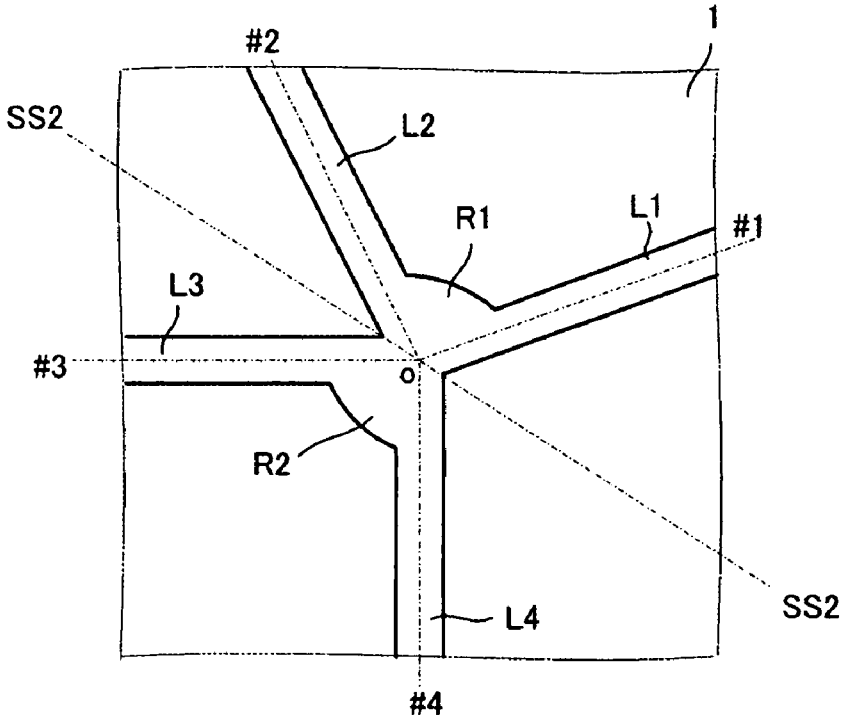
FIGS. 12A and 12B are illustrations of directional couplers according to a fifth preferred embodiment of the present invention.
Figure 12B:
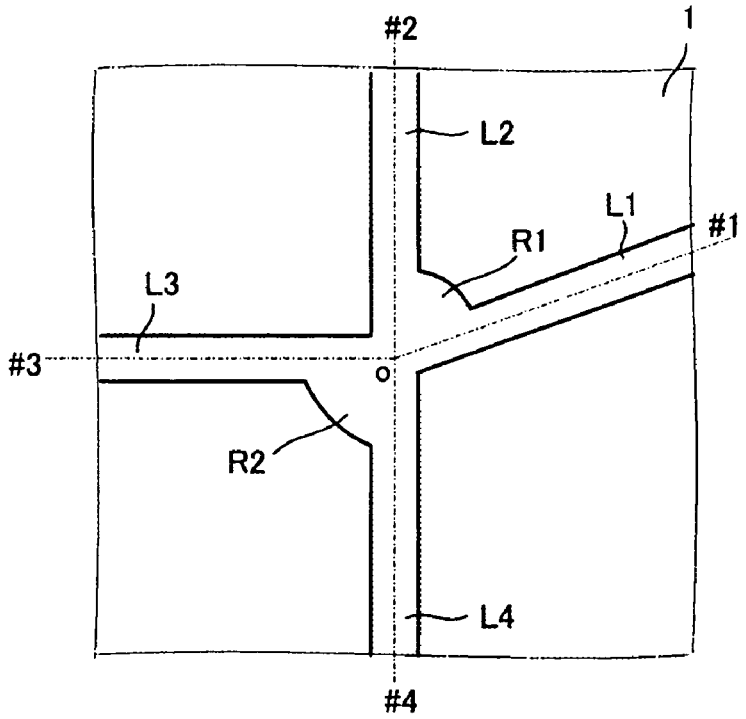

First to fourth lines L1 to L4 and first and second conductor patterns R1 and R2 are formed on a substrate 1 in the manner shown in FIGS. 12A and 12B. In any of the first to fourth preferred embodiments described above, the overall conductor pattern is configured so as to have a double mirror-image geometry in which two symmetry planes extend through the center o. However, the present invention is not limited to such a configuration. As shown in FIG. 12A, the conductor pattern may have a single mirror-image geometry having a single symmetry plane SS2. As shown in FIG. 12B, the conductor pattern may have no symmetry plane. In such configurations, the angles defined between the lines L1 to L4 and the shapes and sizes of the conductor patterns R1 and R2 are appropriately determined, thereby achieving the desired characteristics.

Figure 13:
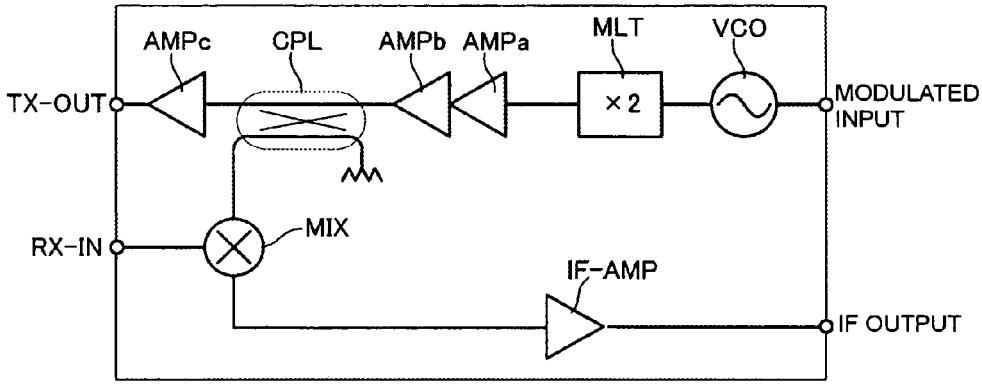
FIG. 13 is a block diagram of a millimeter-wave radar module according to a sixth preferred embodiment of the present invention.

A millimeter-wave radar module according to a sixth preferred embodiment of the present invention will now be descried with reference to FIG. 13.

In FIG. 13, a voltage controlled oscillator VCO oscillates a 38-GHz-band signal, and modulates the frequency of an output signal according to the modulated input signal. An X2 multiplexer MLT multiplies the input signal by a factor of two, and outputs a 76-GHz-band signal. Amplifiers AMPa and AMPb amplify the output signal of the X2 multiplexer MLT. A directional coupler CPL distributes the output signal of the amplifier AMPb in accordance with a predetermined power distribution ratio to an amplifier AMPc and a mixer MIX. The amplifier AMPc power-amplifies the signal from the directional coupler CPL and outputs the amplified signal to a transmitter TX-OUT. The mixer MIX mixes the signal received by a receiver RX-IN with the signal (local signal) from the directional coupler CPL to produce an intermediate-frequency signal of the received signal, and outputs the intermediate-frequency signal to an amplifier IF-AMP. The amplifier IF-AMP amplifies the intermediate-frequency signal of the received signal, and supplies the amplified signal to a receiver circuit as an IF output signal.

The directional coupler CPL employs the directional coupler of any of the first to fifth preferred embodiments described above. A signal processing circuit (not shown) detects the distance to a target and the relative velocity of the radar module based on the relationship between the modulated signal of the voltage controlled oscillator VCO and the intermediate-frequency signal of the received signal.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A directional coupler comprising:

a substrate; and a conductor pattern formed on the substrate, the conductor pattern including:

first to fourth lines, the first to fourth lines connected at and extending radially from a predetermined point on the substrate, each of the first to fourth lines having a respective first point on a center line thereof, the first point being a first distance from the predetermined point;

a first conductive pattern portion defined by the first and second lines and a first connecting line that connects the first point of the first line and the first point of the second line, the first connecting line being one of a curve and a bent line having an inner angle equal to or more than 90° and less than 180°, wherein respective crossing angles defined at an intersection of the first connecting line and edges of the first and second lines is equal to or more than 90° and equal to or less than 180°; and a second conductive pattern portion defined by the third and fourth lines and a second connecting line that connects the first point of the third line and the first point of the fourth line, the second connecting line being one of a curve and a bent line having an inner angle equal to or more than 90° and less than 180°, wherein respective crossing angles defined at an intersection of the second connecting line and edges of the third and fourth lines is equal to or more than 90° and equal to or less than 180°, wherein each of the first to fourth lines has a respective second point on the center line thereof, the second point being a second distance from the predetermined point, wherein the second distance is different from the first distance; and the conductor pattern further includes:

a third conductive pattern portion defined by the second and third lines and a third connecting line that connects the second point of the second line and the second point of the third line, the third connecting line being one of a curve and a bent line having an inner angle equal to or more than 90° and less than 180°, wherein respective crossing angles defined at an intersection of the third connecting line and edges of the second and third lines is equal to or more than 90° and equal to or less than 180°; and a fourth conductive pattern portion defined by the fourth and first lines and a fourth connecting line that connects the second point of the fourth line and the second point of the first line, the fourth connecting line being one of a curve and a bent line having an inner angle equal to or more than 90° and less than 180°, wherein respective crossing angles defined at an intersection of the fourth connecting line and edges of the fourth and first lines is equal to or more than 90° and equal to or less than 180°, wherein stubs are not connected any to of the conductive pattern portions.

2. The directional coupler according to claim 1, wherein the conductor pattern has a double mirror-image geometry having two symmetry planes that extend through the predetermined point.

3. The directional coupler according to claim 1, wherein an angle defined between two adjacent lines of the first to fourth lines is substantially a right angle.

4. A high-frequency circuit device comprising the directional coupler according to claim 1.

5. A directional coupler comprising:

a substrate; and a conductor pattern formed on the substrate, the conductor pattern including:

first to fourth lines, the first to fourth lines connected at and extending radially from a predetermined point on the substrate, each line having a respective first point, the first points of the first and second lines being a first distance from a mutual corner of the first and second line along edges of the first and second lines, the first points of the third and fourth lines being the first distance from a mutual corner of the third and fourth lines along edges of the third and fourth lines;

a first conductive pattern portion defined by the first and second lines and a first connecting line that connects the first point of the first line and the first point of the second line, the first connecting line being one of a curve and a bent line having an inner angle equal to or more than 90° and less than 180°, wherein respective crossing angles defined at an intersection of the first connecting line and edges of the first and second lines is equal to or more than 90° and equal to or less than 180°; and a second conductive pattern portion defined by the third and fourth lines and a second connecting line that connects the first point of the third line and the first point of the fourth line, the second connecting line being one of a curve and a bent line having an inner angle equal to or more than 90° and less than 180°, wherein respective crossing angles defined at an intersection of the second connecting line and the third and fourth lines is equal to or more than 90° and equal to or less than 180°, wherein each of the first to fourth lines has a respective second point, the second points of the second and third lines being a second distance from a mutual corner of the second and third lines along edges of the second and third lines, the second points of the fourth and first lines being the second distance from a mutual corner of the fourth and first lines along edges of the fourth and first lines, wherein the second distance is different from the first distance; and the conductor pattern further includes:

a third conductive pattern portion defined by the second and third lines and a third connecting line that connects the second point of the second line and the second point of the third line, the third connecting line being one of a curve and a bent line having an inner angle equal to or more than 90° and less than 180°, wherein respective crossing angles defined at an intersection of the third connecting line and edges of the second and third lines is equal to or more than 90° and equal to or less than 180°; and a fourth conductive pattern portion defined by the fourth and first lines and a fourth connecting line that connects the second point of the fourth line and the second point of the first line, the fourth connecting line being one of a curve and a bent line having an inner angle equal to or more than 90° and less than 180°, wherein respective crossing angles defined between the fourth connecting line and edges of the fourth and first lines is equal to or more than 90° and equal to or less than 180°, wherein stubs are not connected to any of the conductive pattern portions.

6. The directional coupler according to claim 5, wherein an angle defined between two adjacent lines of the first to fourth lines is substantially a right angle.

7. A high-frequency circuit device comprising the directional coupler according to claim 5.

8. The directional coupler according to claim 5, wherein the conductor pattern has a double mirror-image geometry having two symmetry planes that extend through the predetermined point.

* * * * *